US005918705A

United States Patent [19]

Friend

[11] Patent Number: 5,918,705

[45] Date of Patent: Jul. 6, 1999

[54] BUILDING ELEVATOR DOOR RESTRICTOR

[76] Inventor: Jeff Friend, P.O. Box 2315, Alameda, Calif. 94501

[21] Appl. No.: 08/967,566

[22] Filed: Nov. 10, 1997

[51] Int. Cl.[6] ..... B66B 13/06

[52] U.S. Cl. ..... 187/335; 187/316

[58] Field of Search ..... 187/335, 316, 187/314

[56] References Cited

U.S. PATENT DOCUMENTS

| | | | |
|---|---|---|---|
| 3,905,452 | 9/1975 | Schirmer | 187/1 R |
| 4,216,846 | 8/1980 | Wheeler | 187/409 |
| 5,196,656 | 3/1993 | Mizuno et al. | 187/314 |
| 5,386,882 | 2/1995 | Friend | 184/15.3 |
| 5,583,334 | 12/1996 | Baumann | 187/316 X |
| 5,605,318 | 2/1997 | Malone et al. | 251/129.08 |
| 5,655,627 | 8/1997 | Horne et al. | 187/314 X |
| 5,780,787 | 7/1998 | Kimani et al. | 187/316 |
| 5,821,477 | 10/1998 | Gerstenkorn | 187/316 X |

OTHER PUBLICATIONS

Advanced Microcontrols, Inc. "AMI EDR–02 GENERAL DOCUMENTATION", Feb. 28, 1996, pp. 1–1.

ADAMS Elevator Equipment Co., 4 page sales brochure entitled Hatch Latch(TM), copyrighted 1996.

O.D.I. Co., Door restrictor installation instructions, 7 pages + 3 pages of photos of actual unit, date unknown.

*Primary Examiner*—William E. Terrell
*Assistant Examiner*—Gene O. Crawford
*Attorney, Agent, or Firm*—Harris Zimmerman

[57] ABSTRACT

Opening of an elevator door by occupants of a car which is stalled between building floors is prevented by a locking member which is movable by an electrical actuator between a door locking position and a door releasing position. Opening is permitted at unlocking zones at which the car is at or close to a landing site at a building floor. An infrared emitter and an infrared detector carried by the car pass along opposite sides of a series of opaque door zone vanes situated along the path of car travel. The actuator retracts the locking member in response to blocking of the infrared path between the emitter and detector by a door zone vane. A timer delays the retraction for a period at least equal to the time required for passage of the car through an unlocking zone when it is traveling at rated speed past a floor at which it is not to be stopped.

13 Claims, 5 Drawing Sheets

FIG. 2
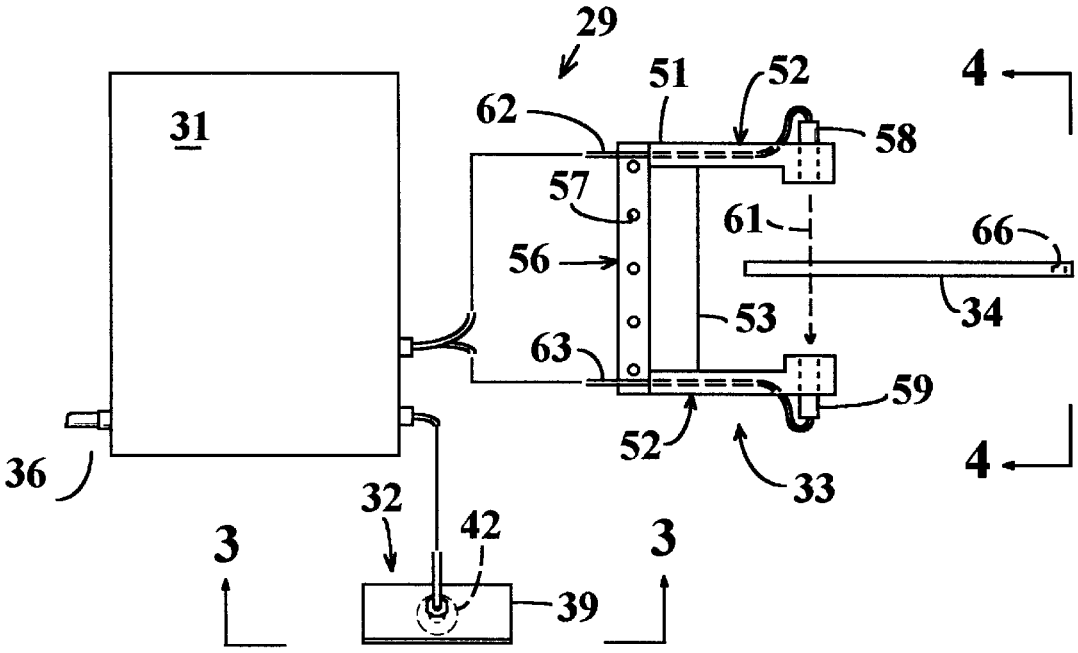
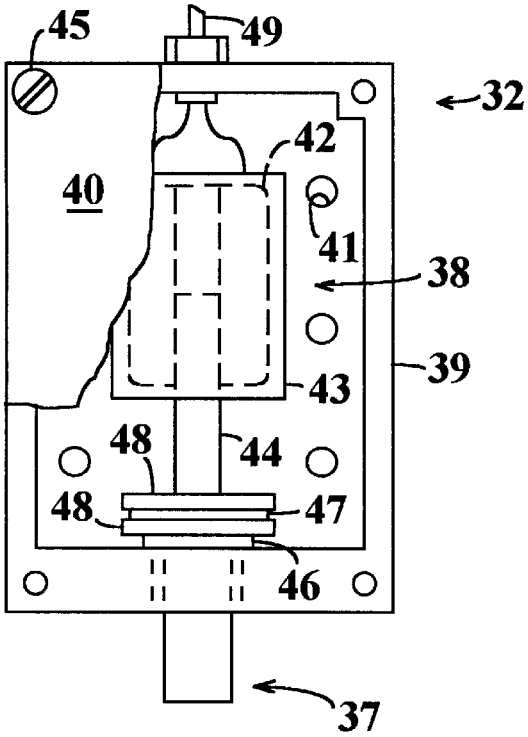
FIG. 3
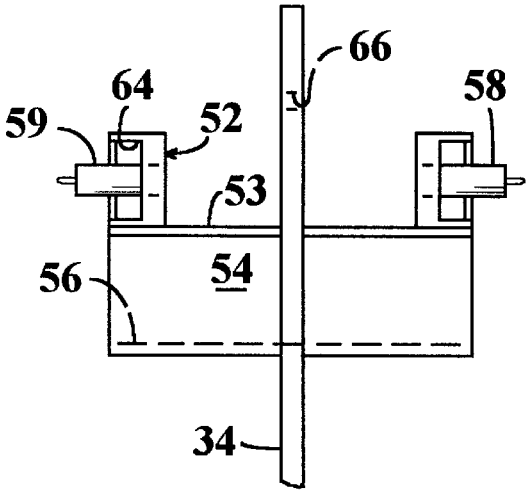
FIG. 4

BUILDING ELEVATOR DOOR RESTRICTOR

TECHNICAL FIELD

This invention relates to safety systems for building elevators and more particularly to systems for preventing opening of elevator car doors by persons inside the car when the car is between floors of a building.

BACKGROUND OF THE INVENTION

Persons trapped in an elevator car which is stalled between floors of a building should remain in the car and await help by trained technicians. Some persons may attempt to force the doors of the car open in an effort to escape. This can be extremely hazardous if the car is not at or close to a landing at which the floor of the elevator is at the same level as a floor of the building. Persons attempting to jump to or climb to a hallway of the building under this circumstance may fall into the hoistway or elevator shaft. Accidents of this kind are prevented by restrictor systems which prevent opening of the elevator car doors from inside the car if the car is not at or close to a landing at a floor of the building.

Restrictor systems of the above discussed kind have some form of latching or locking member that is not accessible to occupants of the elevator car and which must be retracted to enable opening of the door of the car. Sensing means produce a signal at times when the car is at or close to a landing and an electrical actuator retracts the latching or locking member in response to the signal.

The sensing means can be an electrical switch carried by the elevator car and which is operated by contact with members which are fastened to the hoistway wall or an elevator guide rail and which are situated along the path of travel of the switch. Switches of this kind deteriorate from wear, are prone to breakage and require frequent inspection and replacement. To avoid this problem many recent door restrictor systems have photoelectric sensors which detect the location of the elevator car relative to the landings in the building. An infrared light emitter and an infrared detector are carried by the car and are directed towards the elevator guide rail or the hoistway wall. Strips of infrared reflecting material on the guide rail or hoistway wall are positioned to reflect infrared from the emitter back to the detector at times when the elevator car is at or is close to a landing.

Prior elevator door restrictor systems using photo-electric sensing of the above described kind require undesirably frequent maintenance operations as the reflective members gradually acquire a coating of dust and/or other airborne particulates that reduces the reflectivity of the members. This makes it necessary to clean or replace the members at frequent intervals to assure reliability of the system. After a period of time, the reflective tapes can peel off from the surface to which they were affixed.

The present invention is directed to overcoming one or more of the problems discussed above.

SUMMARY OF THE INVENTION

In one aspect the invention provides apparatus for preventing opening of a door of an elevator car by persons inside the car when the car is between unlocking zones that are situated at landings along a vertical path of travel of the car. The apparatus has a locking member carried by the car that is movable between a first position at which the member blocks opening of the door and a retracted position at which the member releases the door. The apparatus further includes a photoelectric unlocking zone detector that is carried by the car and an actuator which moves the locking member to the retracted position thereof in response to detection of an unlocking zone. The unlocking zone detector has a light emitting component and a light detecting component which are spaced apart in a horizontal direction, the light emitting component being positioned to direct light to the light detecting component along a light path which extends across a region that is outside of said car. A plurality of vertically spaced apart stationary opaque door zone vanes are disposed along the path of travel of the car, the door zone vanes being positioned to interrupt the light path when the car is within an unlocking zone.

In another aspect the invention provides a door restrictor system for installation in a building elevator to prevent opening of a door of an elevator car when the car is away from unlocking zones situated at landings along a vertical path of travel of the elevator car. The system includes a plurality of door zone vanes for disposition along the path of elevator travel, each of the door zone. vanes having an opaque region having a height similar to the height of one of the unlocking zones. The system also includes an unlocking zone detector for attachment to the elevator car. The unlocking zone detector has a light emitting component and a light detecting component with the light emitting component being oriented to direct light towards the light detecting component. The light emitting component and light detecting component are spaced apart by a distance sufficient to enable passage of one of the components along first sides of the door zone vanes concurrently with passage of the other of the components along opposite sides of the vanes. The system also includes an electrically operated door locking unit for attachment to the elevator car. The door locking unit has a locking member which is movable between a door locking position and a door unlocking position and has an electrically operated actuator coupled to the locking member to shift the member between the door locking position and door unlocking position in response to electrical signals. A control circuit housing contains components of a control circuit for causing the actuator to move the locking member from the door locking position to the door unlocking position during periods when the light path between the light emitting and light detecting components is blocked by one of the door zone vanes.

The invention protects passengers from the hazards of attempting to escape from a stalled elevator car by locking the car door at times when the floor of the car is sizably out of register with a floor of the building. The apparatus detects the position of the elevator car relative to the floors of the building by photoelectric sensing components in an arrangement which is not dependent on the reflection of light from surfaces that are outside of the car. Consequently the apparatus is not adversely affected by accumulations of dirt or other deposits on such surfaces and does not require periodic cleaning and/or replacement of such reflective surfaces.

The invention, together with further objects and advantages thereof, may be further understood by reference to the following description of the preferred embodiment and by reference to the accompanying drawings.

BRIEF DESCRIPTION OF THE DRAWINGS

FIG. 2 is a plan view depicting components of the door restrictor system shown apart from the elevator car.

FIG. 3 is a broken out elevation view taken along line 3—3 of FIG. 2 further depicting a locking solenoid unit which is a component of the door restrictor system.

FIG. 4 is an elevation view taken along line 4—4 of FIG. 2 further depicting a photoelectric door unlocking zone detector unit which is another component of the door restrictor system.

DETAILED DESCRIPTION OF THE PREFERRED EMBODIMENT

Figure 1:
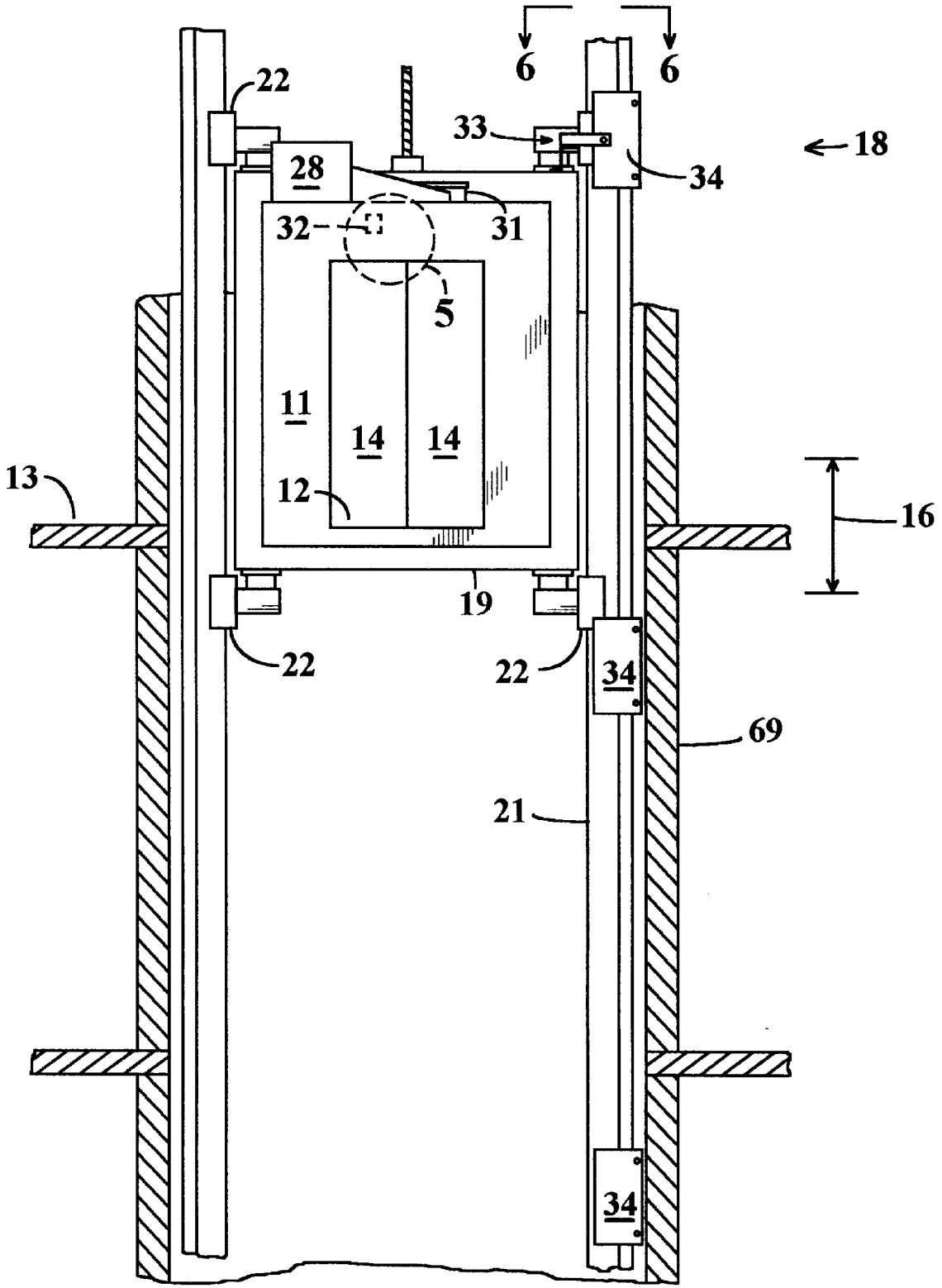
FIG. 1 is a front elevation view of an elevator car having a door restrictor system embodying the invention.

Referring initially to FIG. 1 of the drawings, an elevator car 11 is at what is termed a landing when the top surface 12 of the floor of the car is in register with the top surface 13 of a floor of the building. Safety regulations require that the car doors 14 be unopenable from inside the car by more than a minimal distance except when the car is within an unlocking zone 16 at which it is at a landing or within a prescribed distance from a landing. In the United States of America at this time the prescribed unlocking zone 16 extends from a maximum of 18 inches above a landing to a maximum of 18 inches below a landing. The doors 14 are required to be unopenable from inside the car by more than 4 inches when the car is outside an unlocking zone 16. An elevator door restrictor embodying the present invention functions to limit opening of the car doors 14 from inside the car in a manner consistent with these regulations or with other regulations for the same purpose in which the length of the unlocking zone may be different.

Figure 5:
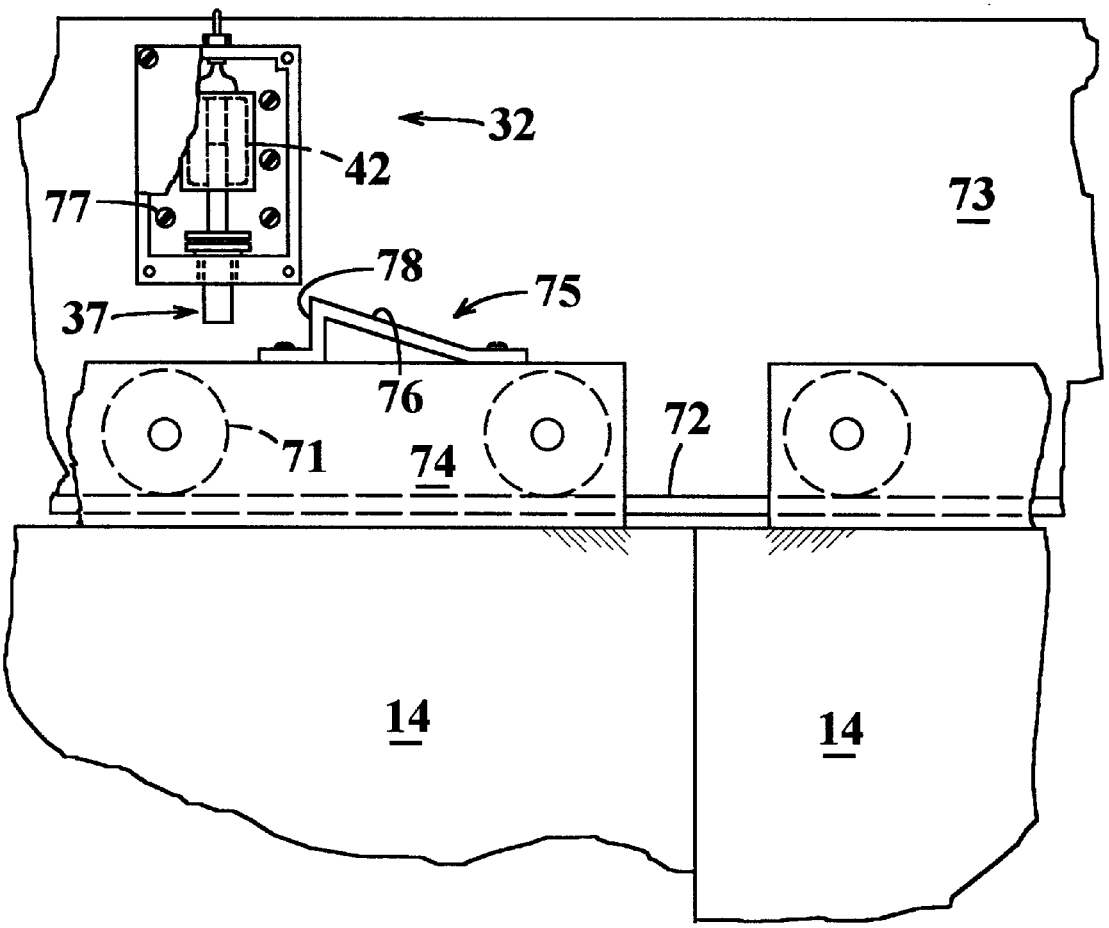
FIG. 5 is a broken out view of the area of FIG. 1 that is enclosed by dashed line 5 in FIG. 1 and which depicts one suitable placement of the locking solenoid unit in relation to door support mechanism of the elevator car.

The door restrictor may be used at elevators 18 of any of the diverse different known constructions. Typically the car 11 has a rectangular shape and, with reference jointly to FIGS. 1 and 5, is cradled by rectangular framework 19 which extends along the top, bottom and sides of the car at a central location on the car. A car guide rail 21, of T-shaped cross section, extends vertically at each side of the car 11. Guides 22 extend laterally from the top and bottom of framework 19 at each side of the framework and have slots 23 into which the central arm 24 of the adjacent guide rail 21 extends. In this example of an elevator 18, U-shaped wear shoes 26 are situated in the slots 23 between guides 22 and the guide rail central arm 24 and are held in place by retainers 27 which are bolted to the top and bottom of each guide 22 and which overlap the top and bottom of the wear shoes. In another common form of elevator, the wear shoes 26 are replaced with rollers which ride against the guide rails 21. Referring again to FIG. 1 in particular, electrically powered door operator mechanism 28 at the top of the car opens and closes the car doors 14.

The above described components of the elevator 18 may be of known construction and therefore will not be described in more detail. Similarly, components of the elevator 18 which are not shown in the drawings, such as the hoist motor and car hoisting mechanism, may be of one of the known designs.

Principal components of the door restrictor 29 which embodies the present invention are shown in FIG. 2, 3 and 4. These include an openable controller box 31, a door locking solenoid assembly 32, a photoelectric unlocking zone detector 33 and a series of door zone vanes 34. Controller box 31 receives utility alternating current although a power conduit 36 and houses electrical circuit components of the system that will hereinafter be described.

The door locking solenoid assembly 32 includes a locking member 37 which is movable between a first position at which it blocks opening of the elevator car doors and a retracted position at which it releases the doors and further includes an actuator 38 which shifts the locking member to the retracted position when detector 33 detects that the elevator car is within an unlocking zone. In this example the door locking assembly 32 has a rectangular housing 39 with a removable cover 40 and has openings 41 at the back which enable the assembly to be fastened to an elevator car with bolts or screws in a manner which will hereinafter be described. The actuator 38 of this example includes a cylindrical solenoid coil 42 which is disposed within the housing 39 in an orientation at which the axis of the coil extends in a vertical direction. The coil 42 is situated within a rectangular support bracket 43 that is secured to the back wall of housing 39.

The locking member 37 of this example of the invention is the lower end of a pin 44 formed of ferromagnetic material which also functions as the armature of the actuator 38. In the first or locking position, the pin 44 extends below the housing 39 and extends upward through a cylindrical flanged bushing 46 at the lower end of housing 39 and extends further upward to an intermediate location within solenoid coil 42. Downward travel of the pin 44 past the locking position of the pin is prevented by a flange 47 on the pin that is of greater diameter than the bushing 46. Annular resilient washers 48 encircle pin 44 immediately above and below the flange 47 to minimize sound when the pin reaches its limits of travel which sound could otherwise be distracting to occupants of the elevator car. Washers 48 are preferably formed of silicone rubber as it is highly resistant to deterioration from the effects of heat, lubricants and the like.

The upper end of pin 44, which is of smaller diameter than the lower end, is proportioned to extend only partially through solenoid coil 42 when the pin is at its locking position at which it protrudes from the lower end of housing 39. Electrical energization of the coil 42 draws the pin 44 upward to a retracted or door unlocking position at which flange 47 bears against support bracket 43 through the upper washer 48 and at which the lower end surface of the pin is coplanar with the lower end surface of housing 39. A flexible insulated electrical cable 49 connects coil 42 with the controller box 31 to enable energization of the coil.

The photoelectric locking zone detector 33 of this example includes a generally U-shaped mounting bracket 51 having parallel arms 52 which extend in a horizontal direction. Arms 52 are secured to a support plate 53 which extends between the arms at the back end of the arms. The back ends of the arms 52 are also spanned by an angle member 54 which extends down from plate 53 and which forms a horizontally extending shelf 56 with spaced part openings 57 for enabling bolting or screwing of the bracket 51 to an elevator car as will hereinafter be described.

A light emitting component 58 is secured to the front end of one of the arms 52 and a light detecting component 59 is secured to the front end of the other arm 52. The components 58 and 59 are preferably of types which operate in the infrared range of wavelengths so that the components need not be shielded from ambient visible light. The light emitting component 58 and light detecting component 59 extend at right angles to bracket arms 52 and are aligned with each other so that component 58 directs infrared towards component 59 along a horizontal light path 61 which extends therebetween.

A second electrical cable 62 connects the light emitting component 58 with the controller box 31 and a third electrical cable 63 connects the light detecting component 59 with the controller box. Arms 52 are preferably hollow except at the front regions of the arms where components 58 and 59 are situated. This enables the portions of the electrical cables 62, 63 that protrude laterally from the elevator car to extend within passages 64 in the arms 52 and thereby be confined and protected from snagging by objects situated outside of the elevator.

Door zone vanes 34 function to interrupt the light path 61 when the elevator car is within an unlocking zone and thus have a length which is equal to the height of the unlocking zone. In this particular example the length is 24 inches, which is smaller than the maximum allowable unlocking zone, although other lengths may be appropriate under some circumstances. The door zone vanes 34 of this example are flat members having openings 66 at their back ends to facilitate attachment to a support surface as will hereinafter be described.

Figure 6:
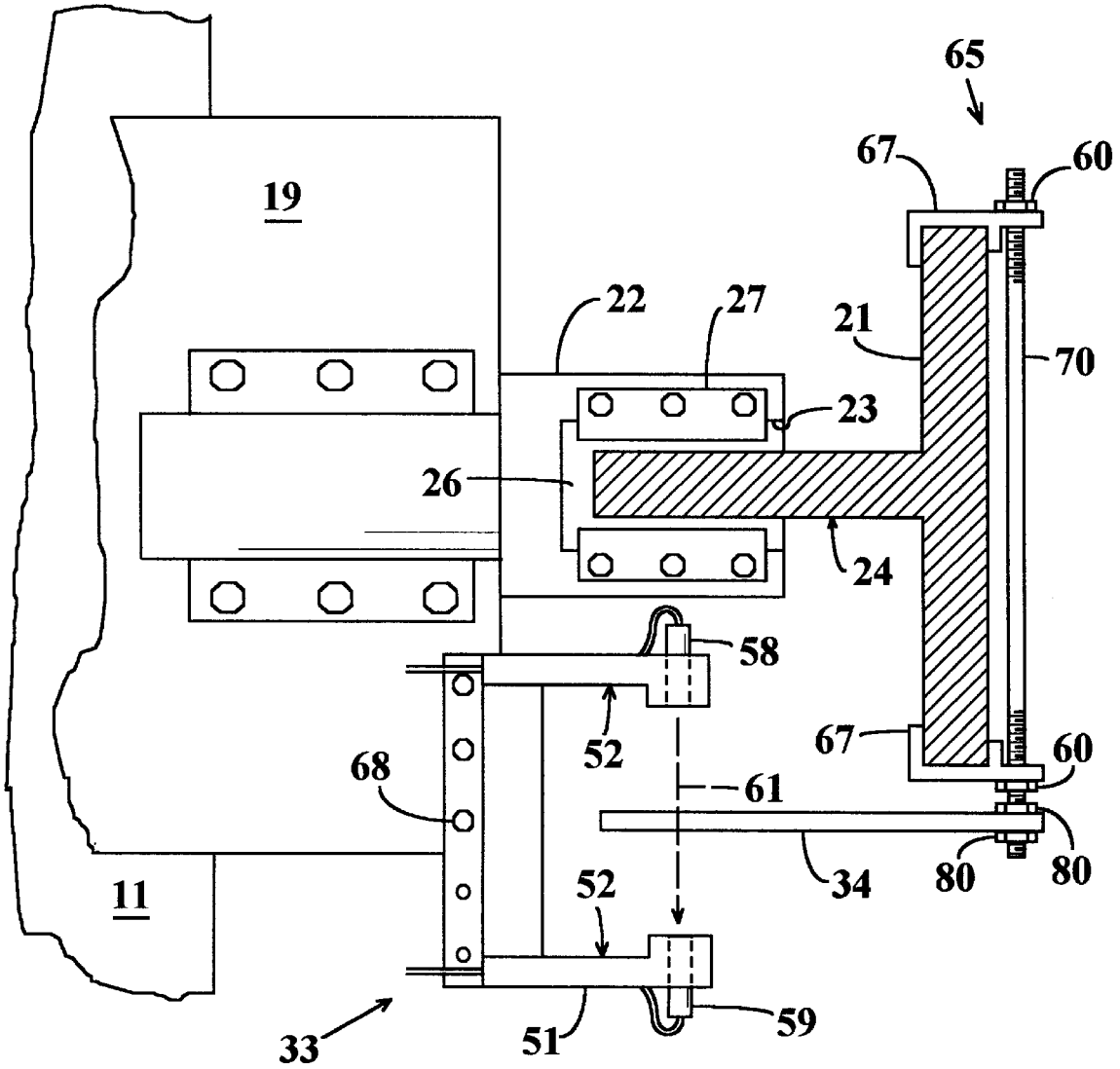
FIG. 6 is a plan view taken along line 6—6 of FIG. 1 and which depicts one suitable placement of the photo-electric door unlocking zone detector unit in relation to the elevator structure.

In use, with reference jointly to FIGS. 1 and 2, controller box 31 is disposed on the top of the elevator car and fastened in place with bolts, screws or by other means. Referring jointly to FIGS. 1 and 6, mounting bracket 51 of the photoelectric locking zone detector 33 is fastened to the top of car 11 at a location where arms 52 protrude laterally from the car. The exact location of mounting bracket 51 is dependent on the location of the door zone vanes 34 which are fastened to stationary structure outside of the car at spaced apart locations along the path of travel of the car. In this particular example the door zone vanes 34 are secured to one of the car guide rails 21 by clamping assemblies 65 in an orientation at which the door zone vanes extend towards the adjacent side of the car 11.

Each such clamping assembly 65 may include a pair of slotted brackets 67 that are fitted onto opposite edges of the car guide rail 21. A threaded rod 70 extends behind the rail 21 and through openings in each such bracket 67. A first pair of threaded nuts 60 are engaged on rod 70 to clamp the brackets 67 to guide rail 21. One end of rod 70 extends through the previously described openings of the door zone vane 34 and the door zone vane is secured to the rod by a pair of lock nuts 80 which are engaged on the rod at opposite sides of the door zone vane. While only a single one of the clamping assemblies 65 appears in FIG. 6, a vertically spaced apart pair of such clamping assemblies is used to support each door zone vane 34.

Mounting bracket 51 in this example is secured to a top corner of the car cradling framework 19 by bolts 68 in a position at which the light emitting component 58 and light detecting component 59 face opposite sides of the door zone vanes 34 when the car is within an unlocking zone. The vertical positions of the door zone vanes 34 are such that the light emitting and detecting components 58 and 59 are directed at a location that is midway between the top and bottom of a door zone vane when the elevator car is level with a landing of the car. Thus the light path 61 between components 58 and 59 is interrupted when the elevator car 11 is within an unlocking zone and is unobstructed at other times.

It should be recognized that the door zone vanes 34 can be situated at other locations such as by being fastened to the hoistway wall 69. The location of the mounting bracket 51 on the elevator car is then changed accordingly to provide for interruption of the light path 61 by the door zone vanes when the elevator car is within an unlocking zone.

Referring jointly to FIGS. 1 and 5, locking solenoid assembly 32 is secured to the elevator car 11 at a location where the locking pin 37 blocks opening of the car doors 14 when it protrudes downward from the assembly housing 39 while enabling such opening when it is retracted upward by energization of solenoid coil 42. The location should also be one at which the assembly 32 is not accessible to occupants of the elevator car but is accessible to elevator technicians who are outside of the car. This location may vary depending on the design of the particular elevator car. In this example, the doors 14 are of the kind that have rollers 71 at the top of the doors that ride along a track 72 at the base of a transverse header member 73 situated at the top of the car. The rollers 71 are attached to hanger brackets 74 which extend upward from the tops of the doors 14. The locking solenoid assembly 32 is secured to the header member 73 by bolts 77 in a position at which the locking member 37, when at its protruding position, intercepts an angled locking bracket 75 that is secured to the top of one of the hanger brackets 74 and which extends upward from the hanger bracket. Locking bracket 75 has a vertical surface 78 which faces in the direction that the underlying door 14 travels as it is being opened and slanting surface 76 which faces in the opposite direction. Opening of the door 14 is blocked by abutment of the vertical surface 78 against the locking member 37 when the solenoid assembly 32 is unenergized and the locking member protrudes from the assembly. The locking bracket 75 does not block closing of the door 14 in the event of a circuit failure as the locking member 37 rides upward along the slanting surface 76 of the bracket when the door is traveled in the door closing direction.

Only a single solenoid assembly 32 and locking bracket 75 is needed to block opening of both doors 14 in instances where the doors are controlled by conventional translating cable mechanism which constrains the doors to open and close simultaneously.

The locking solenoid assembly 32 is preferably positioned to enable a small amount of opening of the door before further opening is blocked, such as by allowing a maximum opening of four inches for example. This does not create a hazard to occupants of the car but does allow them to observe the location of the car in relation to a landing and also facilitates communication with rescuers who are outside of the car.

Locking member 37 can easily be manually lifted by elevator technicians who are outside of the car to enable opening of the doors 14 during rescue operations if that should be necessary.

Figure 7:
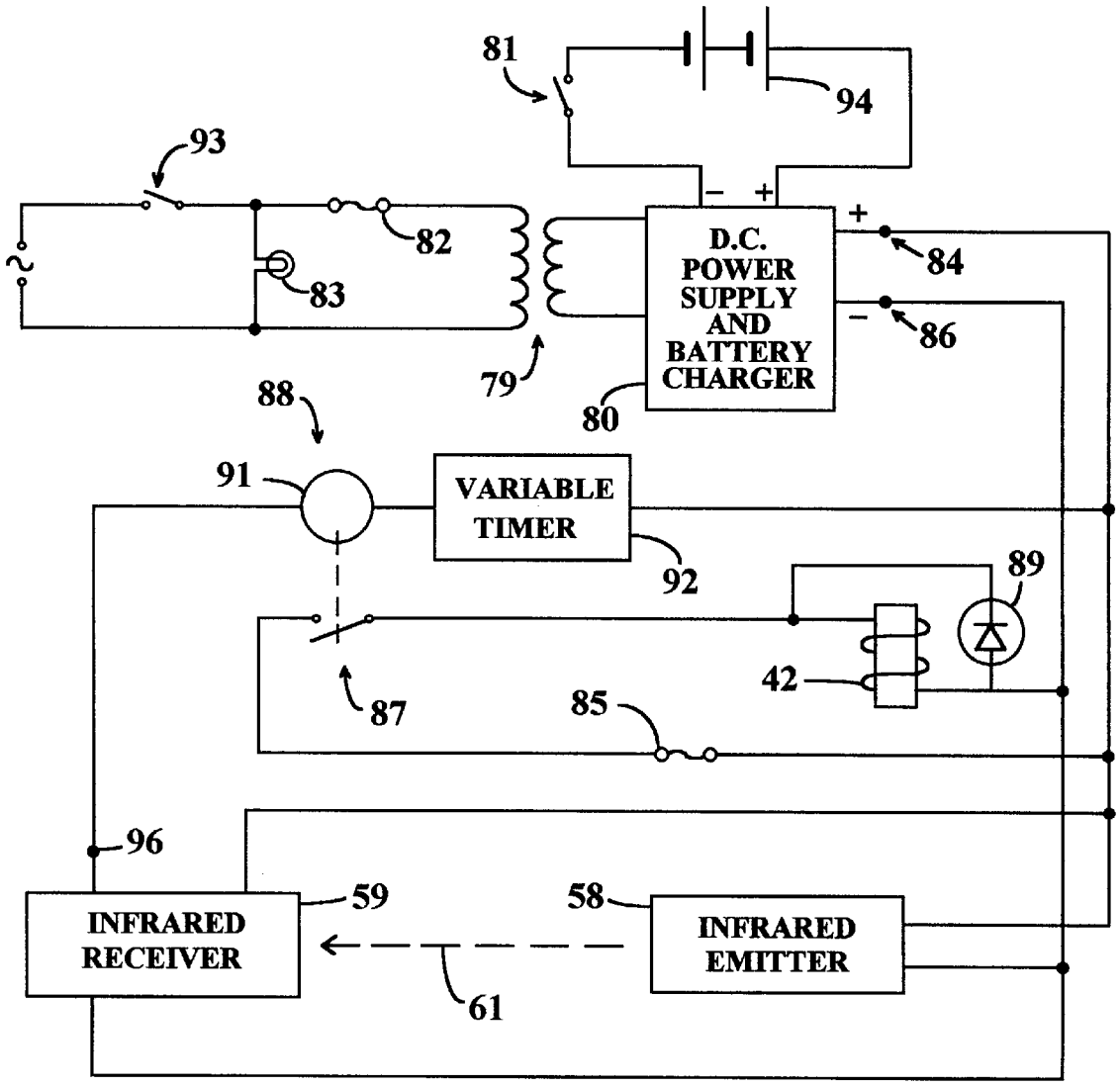
FIG. 7 is a schematic circuit diagram depicting electrical components of the apparatus of the preceding figures.

FIG. 7 depicts an electrical circuit which allows energization of the solenoid coil 42 of the locking solenoid assembly, to enable opening of the elevator car doors by normal automatic operation or by occupants of the car, only when the light path between the light emitting component 58 and light detecting component 59 is interrupted by a door zone vane as previously described. A voltage step down transformer 79 receives utility alternating current power through an on-off switch 93 and through a first fuse 82. An indicator lamp 83 is connected across the AC power lines between switch 93 and fuse 82 to visually signal when the system is on and operating. In this embodiment transformer 79 outputs 24 volt AC current to a direct current power supply 80 which rectifies the AC current. Power supply 80 is of the known form which also functions as a battery charger to maintain standby batteries 94 in a charged condition and which provides an automatic switch over to battery powered operation of the circuit if an AC power failure occurs. The standby batteries 94 provide 24 volt operating power to the circuit if an AC power failure occurs. The batteries 94 are connected to power supply 80 in series relationship with a switch 81 which may be opened to turn off the battery back-up when that is desired.

The light emitting component 58 is an infrared emitter of one of the known types, such as a photodiode for example, which is connected across the positive and negative output terminals, 84 and 86 respectively, of DC power supply 80 and thus is continually on whenever the DC power supply is energized. Solenoid coil 42 of the locking solenoid assembly is connected across the DC power supply terminals 84 and 86 in series relationship with another fuse 85 and with the contacts 87 of a normally open relay 88. A diode 89 is connected across solenoid coil 42 to suppress voltage transients which can occur when a high inductance coil is de-energized.

The normally open relay contacts 87 switch to a closed condition in response to energization of the relay driver coil 91. Driver coil 91 is connected to the positive terminal 84 of the power supply 80 through an adjustable timer 92 of the time delay on type and is connected to the negative power supply terminal 86 through a terminal 96 of the light detecting component 59. The light detecting component 59 of this particular example is a infrared receiver of the known dark on type which provides a conductive path between the terminal 96 and negative power supply terminal 86 in the absence of infrared light and which interrupts the conductive path during periods when infrared light is being received. The light detecting component 59 may, as one example, be a model S18SN6R opposed mode receiver as manufactured by Banner Engineering Corporation of Minneapolis, Minn., U.S.A. Receivers of that type are designed to operate with a light emitting component 58 which is a model S186E emitter that is produced by the same manufacturer. Other light emitting components 58 and light detecting components 59 which provide a similar switching function in response to infrared may also be used.

Consequently, with reference jointly to FIGS. 1 and 7, energization of the relay driver coil 91 can only occur when the light detecting component 59 is in a conductive state which condition occurs when the light path 61 between that component and the light emitting component 58 is blocked by a door zone vane. Energization of the driver coil 91 under that condition closes relay contacts 87 and thereby energizes the locking solenoid 42. This unlocks the elevator car doors in the manner previously described.

Restoration of the light path 61 as the elevator car leaves the unlocking zone disconnects terminal 96 from the negative terminal 86 of power supply 80. This de-energizes relay driver coil 91 and thereby opens relay contacts 87. The resulting de-energization of solenoid coil 42 causes the locking pin 37 to drop to the position depicted in FIG. 5 at which it blocks anything more than a minimal opening of the car doors 14.

Referring jointly to FIGS. 1 and 7, variable timer 92 prevents needless unlocking of the car doors when the car travels at a rated speed past a landing at which it is not to be stopped. The timer 92 delays application of current to relay driver coil 91, following interruption of the light beam 61 by a door zone vane 34 for a period of time sufficient to enable the car to pass the door zone vane without unlocking of the doors 14 when the car is traveling at rated speed. The timer 92 times out and transmits current to the relay driver coil 91 if the car is slowing in preparation for a stop. This closes relay contacts 87 to energize the locking solenoid coil 42 and thereby unlocks the doors in the previously described manner. The timer 92 is preferably adjustable in order to enable the time delay period to be varied to accommodate to different elevator speeds. By way of example, if the door zone vanes 34 have a length of two feet then a car traveling at 100 feet per minute will pass through the unlocking zone in 1.2 seconds. If the timer 92 is set to have a time delay slightly greater than that then unlocking of the car doors does not occur unless the car is slowing in preparation for a stop.

While the invention has been described with reference to a single preferred embodiment for purposes of example, many modifications and variations are possible and it is not intended to limit the invention except as defined by the following claims.

I claim:

1. Apparatus for preventing opening of a door of an elevator car by persons inside the car when the car is between unlocking zones situated at landings along a vertical path of travel of the car which apparatus comprises:

an elevator car having a door and being travelable between unlocking zones, a locking member carried by the car that is movable between a first position at which the member blocks opening of the door and a retracted position at which the member releases the door, said apparatus further having a photoelectric unlocking zone detector carried by said car and an actuator which moves said locking member to said retracted position thereof in response to detection of an unlocking zone, said unlocking zone detector having a light emitting component and a light detecting component which are secured to said elevator car and which are spaced apart in a horizontal direction and which are separated by an open region that is outside of said car, said light emitting component being positioned to direct light to said light detecting component along a light path which extends across said region that is outside of said car, and a plurality of vertically spaced apart stationary opaque door zone vanes disposed along the path of travel of said car, said door zone vanes being positioned to interrupt said light path and to block the passage of light from said light emitting component to said light detecting component when said car is within said unlocking zones.

2. The apparatus of claim 1 wherein said light emitting component and said light detecting component are at locations which are outwardly spaced from an exterior vertical wall surface of said elevator car and wherein said door zone vanes are secured to elevator structure that is adjacent to the path of travel of the elevator car.

3. The apparatus of claim 2 wherein said door zone vanes extend to locations which are closer to said exterior vertical wall surface of said elevator car than the locations of said light emitting component and said light detecting component and wherein a separate one of said door zone vanes is situated between said light emitting component and said light detecting component when said elevator car is within each of said unlocking zones.

4. The apparatus of claim 1 wherein said unlocking zone detector and said door zone vanes are positioned to situate said light path at locations which are midway between the top and bottom of a door zone vane when said elevator car is at landings along said vertical path of travel thereof.

5. The apparatus of claim 1 further including control circuit means for causing said actuator to shift said locking member from said first position to said retracted position when said elevator car is within an unlocking zone which means responds to detection of an unlocking zone by delaying said shifting of said locking member for a period of time at least equal to the time required for said elevator car to travel through an unlocking zone at which the elevator car will not be stopping.

6. The apparatus of claim 1 including a control circuit which directs electrical energization to said actuator in response to detection of an unlocking zone, further including a timer which delays application of said energization to said actuator for a period of time at least equal to the time required for said elevator car to travel through an unlocking zone at which the elevator car will not be stopping.

7. Apparatus for preventing opening of a door of an elevator car by persons inside the car when the car is between unlocking zones situated at landings along a vertical path of travel of the car which apparatus comprises:

an elevator car having a door and being travelable between unlocking zones, a locking member carried by the car that is movable between a first position at which the member blocks opening of the door and a retracted position at which the member releases the door, said apparatus further having a photoelectric unlocking zone detector carried by said car and an actuator which moves said locking member to said retracted position thereof in response to detection of an unlocking zone, said unlocking zone detector having a light emitting component and a light detecting component which are spaced apart in a horizontal direction, said light emitting component being positioned to direct light to said light detecting component along a light path which extends across a region that is outside of said car, a plurality of vertically spaced apart stationary opaque door zone vanes disposed along the path of travel of said car, said door zone vanes being positioned to interrupt said light path when said car is within said unlocking zones, further including first and second mounting bracket arms which extend laterally outward from said elevator car, said light emitting component being secured to the first of said arms and being oriented to direct light towards the second of said arms, said light detecting component being secured to the second of said arms and being positioned and oriented to receive said light which is directed towards the second of said arms by said light emitting component.

8. The apparatus of claim 7 wherein ends of said first and second mounting bracket arms are secured to a support plate which extends therebetween and which holds said first and second mounting bracket arms in a fixed relationship to each other.

9. The apparatus of claim 7 wherein said first and second mounting bracket arms are parallel and coplanar and said light emitting component and said light detecting component are substantially equidistant from said elevator car whereby said light path extends in a horizontal direction which is substantially at righty angles to said arms.

10. The apparatus of claim 7 further including a controller box circuit housing secured to said elevator car and flexible electrical cables coupling said light emitting component and said light detecting component to said controller box circuit housing and wherein said arms of said mounting bracket have hollow regions between said end of said mounting bracket and said light emitting component and said light detecting component and wherein said electrical cables extend through said hollow regions of said arms.

11. Apparatus for preventing opening of a door of an elevator car by persons inside the car when the car is between unlocking zones situated at landings along a vertical path of travel of the car which apparatus comprises:

an elevator car having a door and being travelable between unlocking zones, a locking member carried by the car that is movable between a first position at which the member blocks opening of the door and a retracted position at which the member releases the door, said apparatus further having a photoelectric unlocking zone detector carried by said car and an actuator which moves said locking member to said retracted position thereof in response to detection of an unlocking zone, said unlocking zone detector having a light emitting component and a light detecting component which are spaced apart in a horizontal direction, said light emitting component being positioned to direct light to said light detecting component along a light path which extends across a region that is outside of said car, a plurality of vertically spaced apart stationary opaque door zone vanes disposed along the path of travel of said car, said door zone vanes being positioned to interrupt said light path when said car is within said unlocking zones, wherein said locking member and said actuator are components of a locking solenoid unit, said locking solenoid unit having a housing, a vertically oriented solenoid coil therein situated in spaced apart relationship with a lower end of said housing, a ferromagnetic armature rod extending into said solenoid coil and extending downward therefrom, said locking member being an extension of said armature rod which protrudes through said lower end of said housing when said solenoid coil is unenergized and which is retracted towards said solenoid coil when said solenoid coil is energized, said armature rod having a motion limiting flange situated between said solenoid coil and said lower end of said housing, further including first and second resilient annular washers encircling said armature rod at opposite sides of said flange.

12. An assemblage of door restrictor system components designed for installation in a building elevator to prevent opening of a door of an elevator car when the car is away from unlocking zones situated at landings along a vertical path of travel of the elevator car, comprising:

a plurality of door zone vanes for disposition along said path of travel, each of said door zone vanes having an opaque region with a height similar to the height of one of said unlocking zones, an unlocking zone detector for attachment to said elevator car, said detector having a light emitting component and a light detecting component wherein said light emitting component is oriented to direct light towards said light detecting component along a light path, said light emitting component and said light detecting component being spaced apart by a distance sufficient to enable passage of one of said components along first sides of said door zone vanes concurrently with passage of the other of said components along opposite sides of said door zone vanes, an electrically operated door locking unit for attachment to said elevator car, said door locking unit having a locking member which is movable between a door locking position and door unlocking position and having an electrically operated actuator coupled to said locking member to shift said locking member between said door locking position and door unlocking position in response to electrical signals, a control circuit housing containing components of a control circuit for causing said actuator to move said locking member from said door locking position to said door unlocking position during periods when said light path is blocked by one of said door zone vanes.

13. The apparatus of claim 12 wherein said control circuit includes a timer for delaying operation of said actuator for a selectable period of time following interruption of said light path by a door zone vane.

* * * * *